US007823252B2

(12) United States Patent
Labrasciano

(10) Patent No.: US 7,823,252 B2
(45) Date of Patent: Nov. 2, 2010

(54) ACCESSORY FOR BLOWER

(76) Inventor: Gus Labrasciano, 8 Clayhill Rd., Stamford, CT (US) 06905

( * ) Notice: Subject to any disclaimer, the term of this patent is extended or adjusted under 35 U.S.C. 154(b) by 1741 days.

(21) Appl. No.: 10/877,784

(22) Filed: Jun. 25, 2004

(65) Prior Publication Data

US 2005/0044658 A1 Mar. 3, 2005

Related U.S. Application Data

(60) Provisional application No. 60/482,651, filed on Jun. 26, 2003.

(51) Int. Cl.
*A47L 5/00* (2006.01)
*E01H 6/00* (2006.01)

(52) U.S. Cl. ..... 15/405; 15/246; 37/260; 37/270

(58) Field of Classification Search ..... 15/246, 15/328, 402, 405; 37/259, 260, 270; *A47I 5/00; E01H 6/00*

See application file for complete search history.

(56) References Cited

U.S. PATENT DOCUMENTS 693,093 A 2/1902 Wheeler
736,450 A 8/1903 Sharpe, Jr.
2,675,660 A 4/1954 Barnard
3,999,316 A 12/1976 Palmer
4,064,679 A 12/1977 Spinner
4,118,826 A 10/1978 Kaeser
4,597,203 A 7/1986 Middleton
6,494,514 B1 12/2002 Stinnett et al.

OTHER PUBLICATIONS

Search Report dated Jan. 3, 2005 from corresponding PCT Appl. No. PCT/US04/20683.

*Primary Examiner*—David A Redding
(74) *Attorney, Agent, or Firm*—Ohlandt, Greeley, Ruggiero & Perle, L.L.P.

(57) ABSTRACT

An accessory for a blower having a first end with a connector assembly for connecting the accessory to the blower, a second end for directing air under pressure from the blower, a lower blade portion extending at least partly between the first end and the second end for facilitating a pneumatic shoveling operation, and an upper funnel portion extending at least partly between the first end and the second end for facilitating a pneumatic sweeping operation. The accessory can be selectively connected to the blower via the connector assembly so that the air under pressure from the blower cooperates with the lower blade portion and the upper funnel portion to perform a combined pneumatic shoveling/sweeping operation.

16 Claims, 4 Drawing Sheets

ACCESSORY FOR BLOWER

CROSS REFERENCE TO RELATED PATENT APPLICATIONS

This application hereby claims priority to U.S. Provisional Patent Application Ser. No. 60/482,651 filed on Jun. 26, 2003, which is herein incorporated by reference in its entirety.

BACKGROUND OF INVENTION

1. Field of the Invention

The present invention relates generally to yard maintenance equipment. More particularly the present invention relates to accessories for blowers.

2. Description of the Related Art

Various devices capable of producing relatively high-velocity, low-pressure airflow for sweeping or clearing various large outdoor surface areas are well known. Further, devices capable of mechanically, via a blade or scoop assembly, sweeping or clearing various outdoor surface areas are also well known. It is also well known to adapt such devices to accomplish more than one operation.

For example, U.S. Pat. No. 2,675,660 discloses a machine usable with various attachments to facilitate mowing, snow blowing, or lawn cleaning. U.S. Pat. No. 3,999,316 discloses a combination snow blower and lawn sweeper; U.S. Pat. No. 4,064,679 discloses a convertible combination snow blower, lawn mower and lawn sweeper; and U.S. Pat. No. 4,597,203 discloses a device that cooperates with a variety of similarly attachable conversion units adapting the device for additional uses.

Notwithstanding the foregoing, there remains an ongoing need for an efficient, effective and economical method and/or accessory for adapting a blower or like apparatus for more than one use.

SUMMARY OF THE INVENTION

It is an object of the present invention to provide an improved accessory that satisfies the above identified need.

This and other objects and advantages of the present invention are achieved by an accessory for use with a blower.

The accessory has a first end cooperative with the blower and having a connector assembly associated therewith, a second end for directing air under pressure from the blower, a lower blade portion extending at least partly between the first end and the second end for facilitating a pneumatic operation, and an upper funnel portion for facilitating a pneumatic sweeping operation. The accessory can be selectively connected to the blower via the connector assembly so that the air under pressure from the blower can cooperate with the lower blade portion and the upper funnel portion to perform one or more pneumatic operations.

BRIEF DESCRIPTION OF THE DRAWINGS

Other and further objects, advantages and features of the present invention will be understood by reference to the following specification in conjunction with the accompanying drawings, in which like reference characters denote like elements of structure.

DETAILED DESCRIPTION OF THE PREFERRED EMBODIMENT

Figure 1:
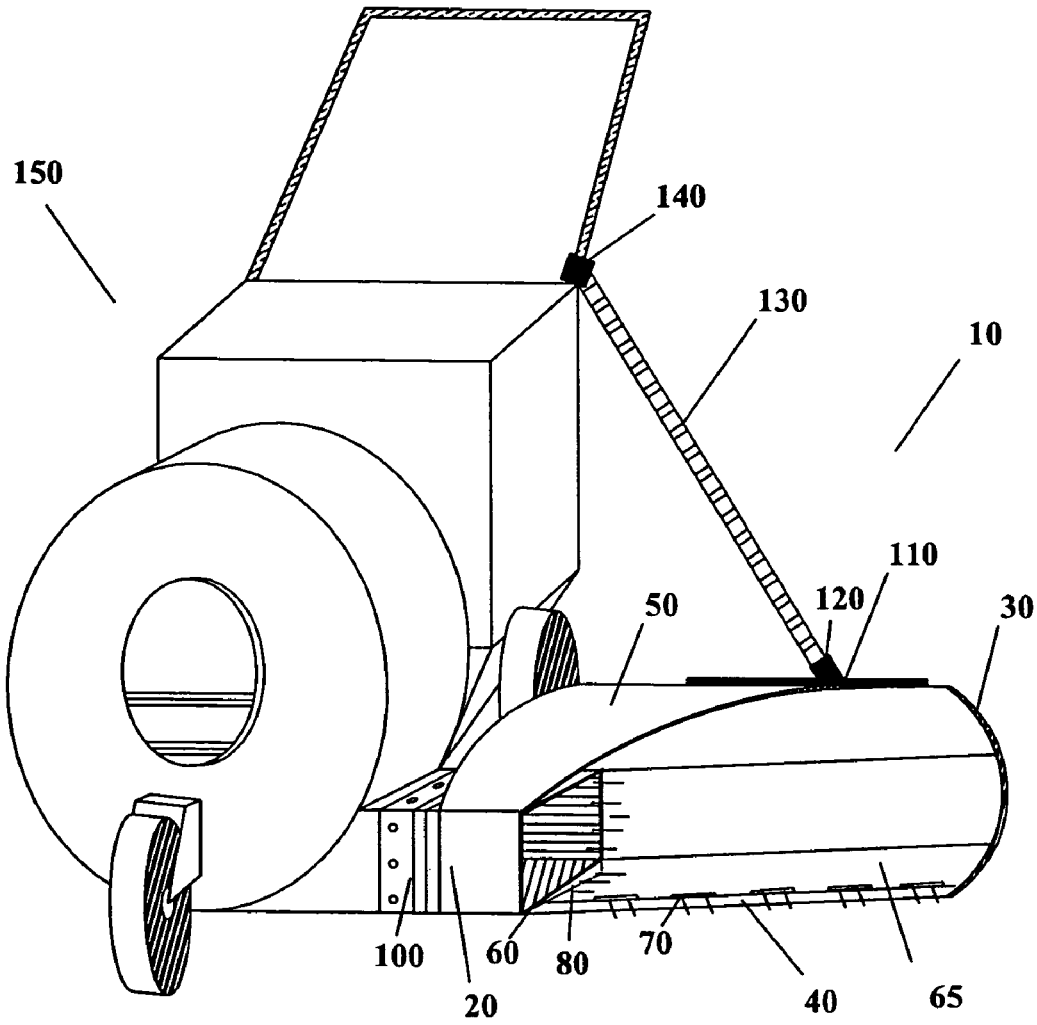
FIG. 1 is a perspective view of an accessory for cooperation with a blower in accordance with an illustrative embodiment of the present invention, the accessory being in combination with a typical blower.

Referring to the drawings and, in particular to FIG. 1, there is shown a first illustrative embodiment of an accessory for use with a blower, generally represented by reference numeral 10.

The accessory 10 essentially has a first end 20 for cooperating with the blower 150, the first end 20 having a connector assembly 100, a second end 30 for directing air under pressure from the blower 150, a lower blade portion 40 extending at least partly between the first end 20 and the second end 30 for facilitating a pneumatic operation, and an upper funnel portion 50 for enhancing the pneumatic operation.

Referring to FIG. 1, the first end 20 preferably has one or more apertures 60 for facilitating the transfer of air under pressure from the blower 150 to the upper funnel portion 50 and/or the lower blade portion 40. The one or more apertures 60 preferably being cooperative with a variety of different air flow manipulating elements.

The connector assembly 100 is preferably selected from a group consisting of a gate connector, a pivoting connector, a rotating connector, a sliding connector, and a rigid connector. Other types of connectors as known in the art may also be used.

Referring to FIG. 1, the second end 30 has one or more grooves or channels 65 for channeling the air under pressure from the blower 150. The second end 30 can also preferably be telescopically adjusted and/or pivotally positioned relative to the blower 150. Other adjusting features suitable to accomplish the intended objects of the accessory may also be had by the second end 30.

The lower blade portion 40 is preferably formed of a durable material having sufficient resiliency for prolonged use and minimal wear and tear. The lower blade portion 40 can be hollow with one or more apertures 70 disposed therein.

The one or more apertures 70 preferably lead to a hollow interior 80 of the blade portion 40. The hollow interior portion 80 is preferably in fluid communication with the blower 150 via the connector assembly 100. Other methods for communicating air from the blower 150 to the accessory may also be used.

Preferably, the lower blade portion 40 facilitates one or more pneumatic operations such as, for example, shoveling, sweeping and/or raking.

Figure 2:
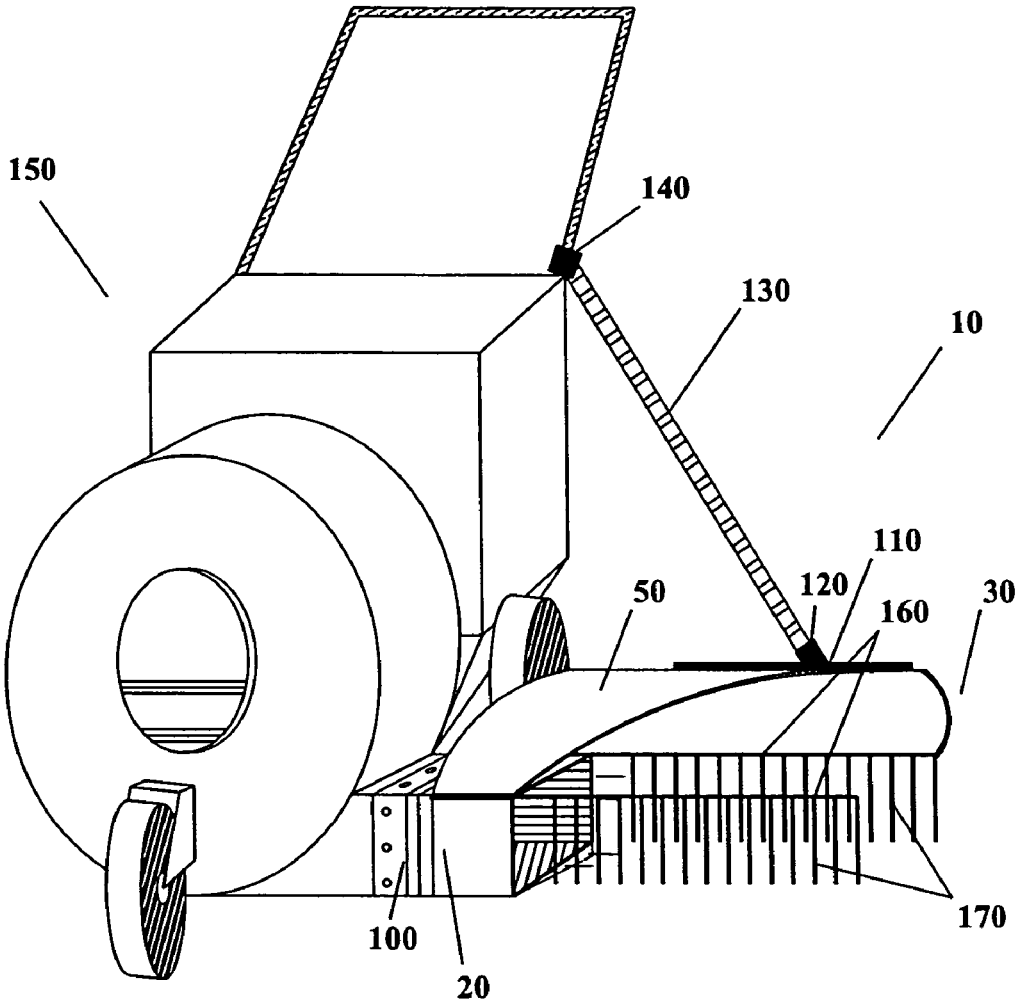
FIG. 2 is a perspective view of an accessory for cooperation with a blower in accordance with another illustrative embodiment of the present invention, the accessory being in combination with a typical blower.
Figure 3:
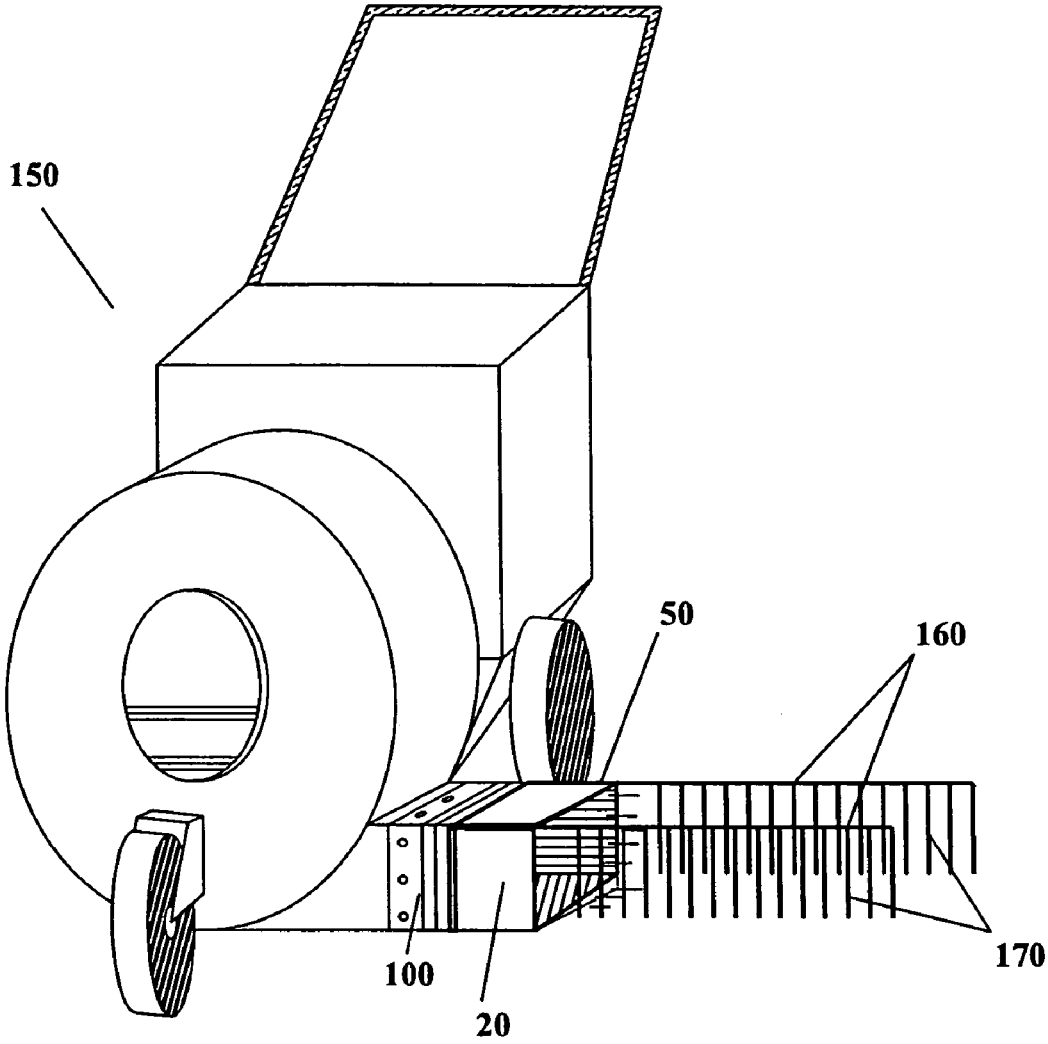
FIG. 3 is a perspective view of an accessory for cooperation with a blower in accordance with still another illustrative embodiment of the present invention, the accessory being in combination with a typical blower.

Alternatively, referring to FIG. 2, the lower blade portion 40 can have one or more projecting elements 160 preferably having a plurality of teeth 170 extending therefrom. Preferably, the plurality of teeth 170 facilitate in one or more of the pneumatic operations.

It is noted that the accessory 10 can also have one or more projecting elements 160 connected to the blower 150 via any known method for accomplishing such a task.

An upper funnel portion 50 preferably improves the flow of air under pressure from the blower through, in and/or across the accessory. Preferably, the upper funnel portion 50 has a rear portion with one or more connectors for selectively and adjustably receiving and securing a secondary support element.

Preferably, the secondary support element is a telescoping support rod. The secondary support preferably has a first end 20 for cooperating with the one or more connectors and a second end 30 for selectively and adjustably connecting to the blower to facilitate the effective cooperative use of the blower with the accessory. The one or more connectors preferably can be pivoting connectors, or sliding siding connectors, or rotating connectors. Other types of connectors suitable for the intended objects of the accessory may also be used.

Figure 4:
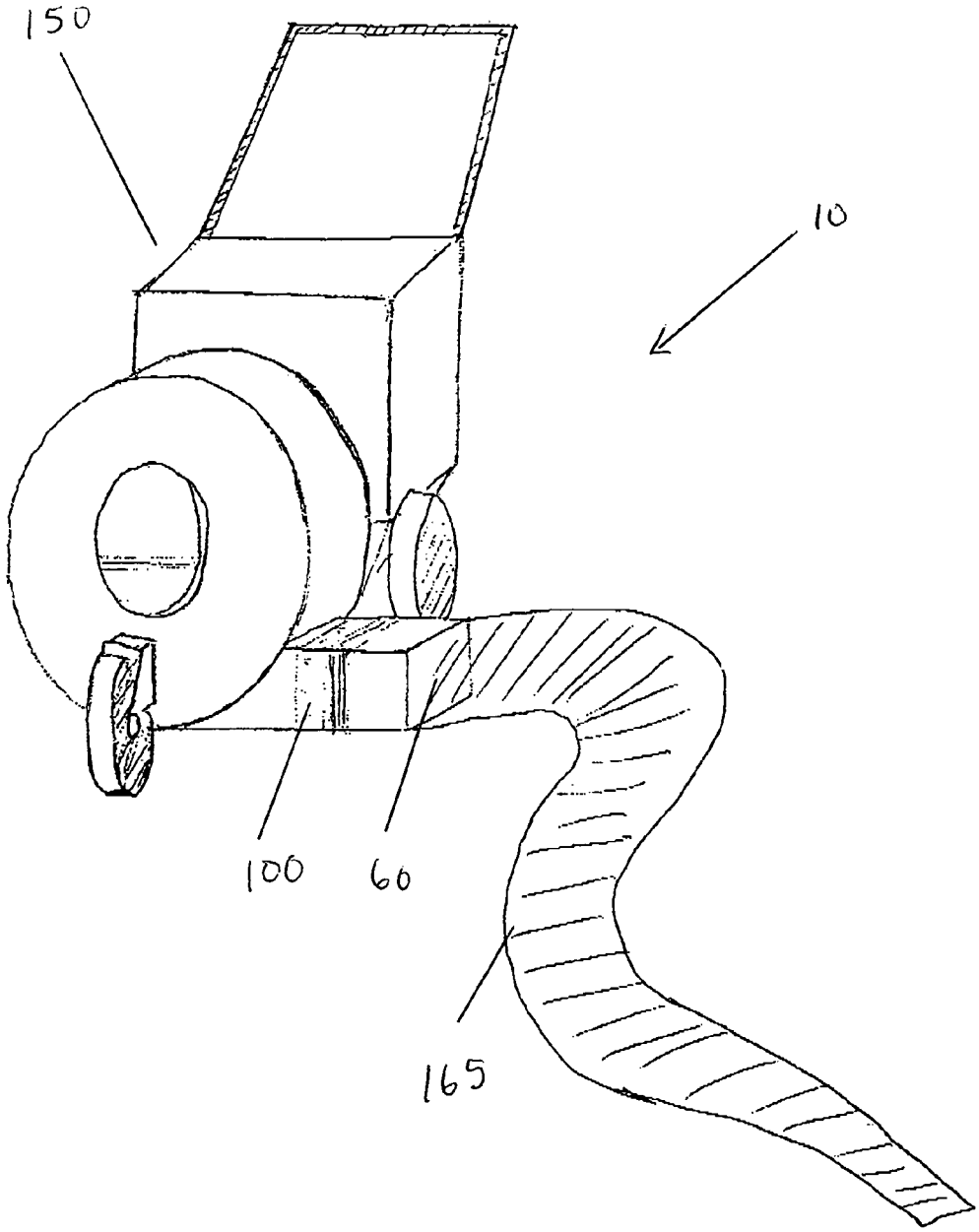
FIG. 4 is a perspective view of an accessory for cooperation with a blower in accordance with still another illustrative embodiment of the present invention with a hose.

Referring now to FIG. 4, there is shown another exemplary embodiment of the present invention. Referring to FIG. 4, the first end 20 preferably has one or more apertures 60 for facilitating the transfer of air under pressure from the blower 150 to a hose 165. The hose 165 is preferably a flexible member for transferring air from the blower 150 to another device or alternatively for usage to blow pressurized air. Preferably, the hose 165 has a complementary sized diameter relative to the one or more apertures 60 and the connector assembly 100 of the blower 150 for preferably being cooperative with a variety of different air flow manipulating elements. The flexible hose 165 preferably is made from a durable lightweight material and optionally may be connected to a nozzle (not shown).

Having described the various features of the accessory in accordance with an illustrative embodiment, the preferable purpose of the accessory is to provide a device that can be selectively connected to any upright blower via a connector assembly so that air under pressure from the blower preferably cooperates with a lower blade portion 40 and an upper funnel portion 50 to perform a combined pneumatic shoveling/sweeping operation.

The present invention having been thus described with particular reference to the preferred forms thereof, it will be obvious that various changes and modifications may be made therein without departing from the spirit and scope of the present invention as defined herein.

What is claimed is:

1. An accessory for a blower comprising: a first end for cooperating with a blower, said first end having a connector assembly; a second end including a wall extending toward the first end for directing air under pressure from said blower; a lower blade portion extending at least partly between said first end and said second end for facilitating a pneumatic shoveling operation; and an upper funnel portion for facilitating a pneumatic sweeping operation, wherein said accessory can be selectively connected to said blower via said connector assembly so that said air under pressure from said blower can cooperate with said lower blade portion, and wherein said upper funnel portion performs a combined pneumatic shoveling/sweeping operation, wherein said first end has one or more apertures.

2. The accessory of claim 1, wherein said one or more apertures facilitate the transfer of air under pressure from said blower to said upper funnel portion and/or said lower blade portion.

3. The accessory of claim 2, wherein said one or more apertures can cooperate with a variety of different air flow manipulating elements.

4. An accessory for a blower comprising: a first end for cooperating with a blower, said first end having a connector assembly; a second end for directing air under pressure from said blower; a lower blade portion extending at least partly between said first end and said second end for facilitating a pneumatic shoveling operation; and an upper funnel portion for facilitating a pneumatic sweeping operation, wherein said accessory can be selectively connected to said blower via said connector assembly so that said air under pressure from said blower can cooperate with said lower blade portion, and wherein said upper funnel portion performs a combined pneumatic shoveling/sweeping operation, wherein said second end can be telescopically adjusted.

5. An accessory for a blower comprising: a first end for cooperating with a blower, said first end having a connector assembly; a second end for directing air under pressure from said blower; a lower blade portion extending at least partly between said first end and said second end for facilitating a pneumatic shoveling operation; and an upper funnel portion for facilitating a pneumatic sweeping operation, wherein said accessory can be selectively connected to said blower via said connector assembly so that said air under pressure from said blower can cooperate with said lower blade portion, and wherein said upper funnel portion performs a combined pneumatic shoveling/sweeping operation, wherein said blade portion is hollow with one or more apertures therein.

6. The accessory of claim 5, wherein said one or more apertures lead to a hollow interior of said blade portion.

7. The accessory of claim 6, wherein said hollow interior portion is in fluid communication with said blower.

8. The accessory of claim 7, wherein said interior portion is in fluid communication with said blower via said connector assembly.

9. An accessory for use with a blower comprising: a first end for cooperation with a blower; a second end for directing air under pressure from said blower; a blade portion extending at least partly between said first end and said second end; a rear portion having one or more connectors for selectively and adjustably receiving and securing a secondary support element, wherein said secondary support element has a first end for cooperating with said one or more connectors and a second end for selectively and adjustably connecting to said blower.

10. The accessory of claim 9, wherein said blade portion is hollow with one or more apertures therein.

11. The accessory of claim 10, wherein said one or more apertures lead to a hollow interior of said blade portion.

12. The accessory of claim 11, wherein said hollow interior portion is in fluid communication with said blower.

13. The accessory of claim 12, wherein said interior portion is in fluid communication with said blower via a connector at said first end of said accessory.

14. An accessory for a blower comprising; a first end for cooperation with a blower; a second end for directing air under pressure from said blower; a blade portion extending at least partly between said first end and said second end; and a rear portion having one or more connectors for selectively and adjustably receiving and securing a telescoping support, wherein said telescoping support has a first end for cooperating with said one or more connectors and a second end for selectively and adjustably connecting to said blower to facilitate the effective cooperative use of said blower with said accessory.

15. The accessory of claim 14, wherein said one or more connectors are pivoting connectors.

16. The accessory of claim 14, wherein said one or more connectors are siding connectors.

* * * * *